US005328037A

United States Patent [19]

Fujii

[11] Patent Number: 5,328,037

[45] Date of Patent: Jul. 12, 1994

[54] MAGAZINE DISPLAY RACK

[76] Inventor: Glenn Fujii, 1648-D Locust Ave., Bohemia, N.Y. 11716

[21] Appl. No.: 73,053

[22] Filed: Jun. 8, 1993

[51] Int. Cl.[5] ..... A47F 5/00

[52] U.S. Cl. ..... 211/55; 211/88; 211/94

[58] Field of Search ..... 211/50, 55, 88, 94, 211/87, 128

[56] References Cited

U.S. PATENT DOCUMENTS

| | | | |
|---|---|---|---|
| 3,515,283 | 6/1970 | Poteat | 211/55 |
| 4,162,014 | 7/1979 | Bobrick | 211/55 X |
| 4,588,094 | 5/1986 | Evans | 211/55 |
| 4,817,900 | 4/1989 | Whittington et al. | 211/94 X |
| 4,844,266 | 7/1989 | Small et al. | 211/88 |
| 4,938,366 | 7/1990 | Carroll | 211/55 |
| 4,955,488 | 9/1990 | Nicoll | 211/55 X |
| 4,961,295 | 10/1990 | Kosch et al. | 211/94 |
| 5,141,115 | 8/1992 | Nicoll | 211/55 |

*Primary Examiner*—Robert W. Gibson, Jr.

[57] ABSTRACT

In a multi-tiered magazine display rack in each tier of which cooperating left and right brackets engage opposite bottom corners of the displayed magazine positioned therebetween, the provision of a notch in an upper tier bracket to receive the wall of a next adjacent lower tier bracket so that the alignment of the left and right brackets are vertical, rather than progressively offset, and this vertical alignment contributes to an enhanced appearance in the display rack.

1 Claim, 2 Drawing Sheets

MAGAZINE DISPLAY RACK

The present invention relates to improvements in a magazine display rack, which allow for varying widths of displayed magazines and contribute to an enhanced appearance in the rack.

EXAMPLES OF THE PRIOR ART

Vertical tiers in a display rack are understandably desirable since they contribute to increasing the quantity of displayed magazines. Prior art examples of such racks are shown and illustrated in U.S. Pat. No. 855,862 issued to L. L. Morse on Jun. 4, 1907 for "Seed Display Rack" and in U.S. Pat. No. 4,162,014 issued to Mitchell Bobrick on Jul. 24, 1979 for "Vertical File Construction".

Undoubtedly because adjacent tiers overlap, the brackets thereof are fixed in position and are in vertical rows of uniform widths. This, of course, restricts the displayed magazines to either corresponding uniform widths or to widths that are smaller than the span between adjacent brackets, the latter in particular having an undesirable appearance of unused display space.

Broadly, it is an object of the present invention to provide a magazine display rack of the vertically tiered category, overcoming the foregoing and other shortcomings of the prior art.

More particularly, it is an object to allow for adjustments in the span between cooperating magazine-supporting brackets and, additionally, to achieve a vertical alignment in the brackets of the tiered arrangement which contributes to a noteworthy appearance in the display rack.

The description of the invention which follows, together with the accompanying drawings should not be construed as limiting the in the art to which this invention appertains will be able to invention to the example shown and described, because those skilled devise other forms thereof within the ambit of the appended claims.

Figure 1:
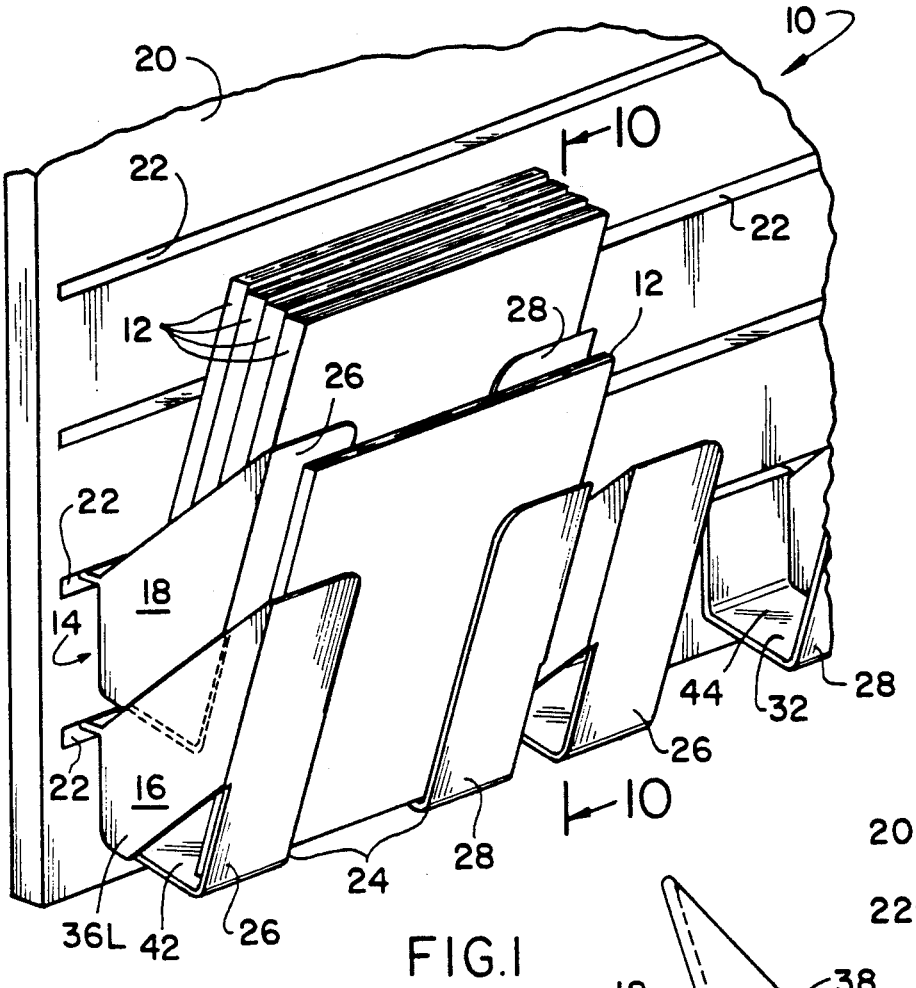
FIG. 1 is a partial perspective view showing the magazine display rack of the present invention using cooperating identically constructed pairs of brackets, one on the right and the other on the left of a magazine in display position therebetween.

Shown in partial perspective in FIG. 1 is the within inventive rack 10 for the display of magazines 12. Rack 10 in practice is provided with plural vertically-spaced tiers 14, of which in FIG. 1 only two tiers are illustrated, namely a lower position tier 16 and the next above tier 18. The functioning of adjacent tiers, as demonstrated by tiers 16 and 18, to provide an enhanced appearance is the patentable advance, and thus for simplicity sake, the description which follows is confined to tiers 16 and 18, it being understood that the relationship therebetween is also embodied in all the other tiers. Rack 10 includes a panel 20 having a select number of horizontal slots 22 spaced evenly and constructed as shown in detail in FIG. 10 for the mounting of multiple pairs of support brackets, individually and collectively designated 24, which have a side by side display position in the tiers 14 in which positions there are brackets on the left and on the right which cooperate to constitute a pair of brackets between which magazines are placed for display. That is, from a perspective in front of the rack and as seen by the prospective purchaser, and as will be explained in greater detail subsequently, the bottom corners of a displayed magazine will have its left bottom corner in a left bracket, and its right bottom corner in a right bracket, and the space between the left and right brackets is selected to correspond to the width of the magazine being displayed therebetween. Except for the positioning on the left as distinguished from the positioning on the right of a magazine, the brackets are essentially identically constructed, all as will now be explained specifically in reference to FIGS. 2-9, to which reference should now be made.

The bracket on the right side of a displayed magazine is more particularly designated 26 in FIGS. 2-5, whereas a left side positioned bracket is more particularly designated 28 and shown in FIGS. 6-9. Each of the brackets 26, 28 has a rear wall 30, bottom wall 32, a front wall 34 and an "outboard" side wall 36, said wall 36 being on the right from a frontal perspective of bracket 26 and on the left on bracket 28, the former being more particularly designated 36R and the latter 36L respectively. At the upper end of each rear wall 30 of brackets 26, 28 there is a right angle offset extension 30' which in a well understood manner is adapted to be projected into a slot 22 (FIG. 10) on panel 20 incident to permitting a sliding degree of movement in the brackets 26, 28 relative to the support panel 20.

Underlying the present invention is the construction of the brackets 26 and 28, as well as the method of use, which permits the side walls 36R and 36L respectively of the brackets to assume in the display of the magazines a vertically oriented relation. In other words, the cooperating pairs of brackets have all of the side walls 36R and all of the side walls 36L of the vertical tiers in a vertical orientation. This is to be distinguished from a display in which the referred-to side walls 36L, 36R are in adjacent relationship to each other in adjacent tiers so that the resulting display is one in which the walls appear to be converging, as one proceeds from a lower to each adjacent higher tier. This undesirable "converging" appearance is that of a pyramid and in practice detracts from the appearance of the display rack. The avoidance of a "pyramid" appearance is achieved primarily by the construction of the side walls 36R and 36L. More particularly, each of the side walls have an upper angularly oriented edge 38 in spaced relation between the front wall 34 and rear wall 30. In cooperation therewith, a parallel lower edge 40 defines a notch or cutout 42 in the side wall. As a consequence, walls 30, 32, 24 and 36 define a compartment 44 within each of the brackets 26 and 28 to contain opposite bottom corners of magazines 12. In use, it is contemplated that each cooperating pair of brackets 24 consisting in each pair of brackets 26 and 28 be disposed so as to be slidable in slots 22 relative to each other to correspond to the width of the magazines 12. It is during the sliding movements of the brackets in adjacent tiers that the brackets can be directly in vertical alignment with each other and the pyramid effect obviated. This is achieved by a side wall of a bracket of a lower tier having a seated position within a notch of a bracket of the next above tier. Thus, as may be readily understood from FIG. 1, and using brackets 26 as an example, side wall 36L of bracket 16 in the lower tier is shown to have its upper angular edge seated in the notch of the side wall of bracket 18 of the tier above it. The seating referred to is also illustrated in the cross sectional view of FIG. 10 and denoted by the reference numeral 40, which reference numeral also identifies the lower edge of the side wall, and also the edge which bounds the notch 42.

Figure 11:
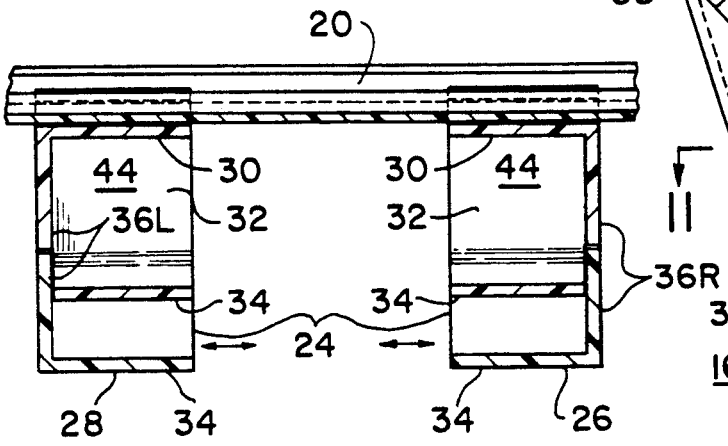
FIG. 11 is a cross sectional view as taken along line 11-11 of FIG. 10.
Figure 10:
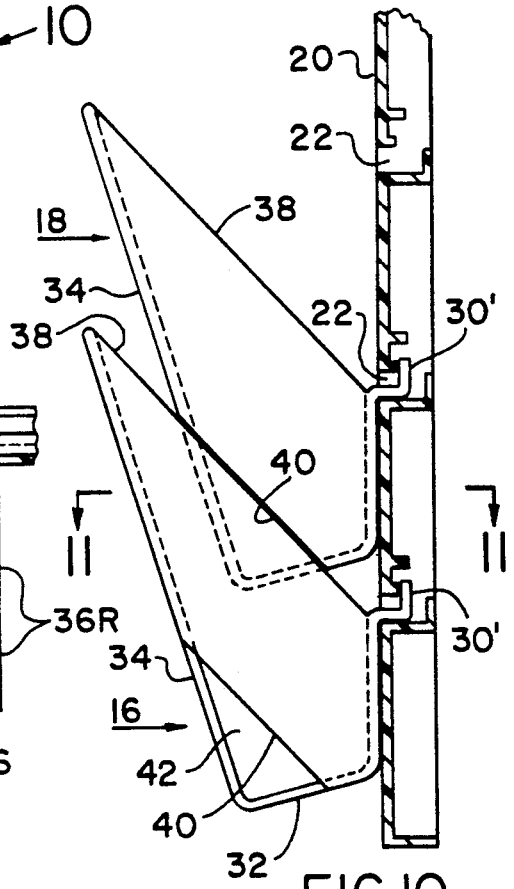
FIG. 10 is a side elevational view, in cross section, as taken along line 10—10 of FIG. 1.
Figure 2:
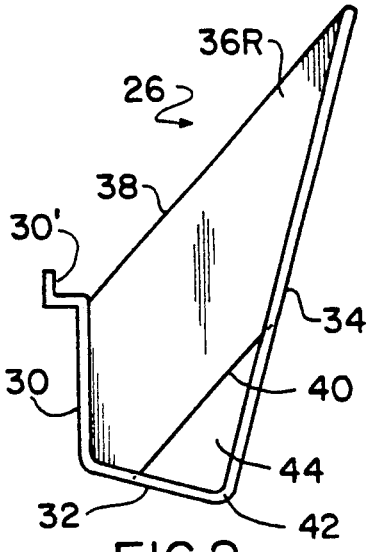
FIGS. 2–5 and 6–9 are respectively right side elevation, front elevation, left side elevation and bottom views of said right and said left bracket of said pair of brackets used in the display device.
Figure 3:
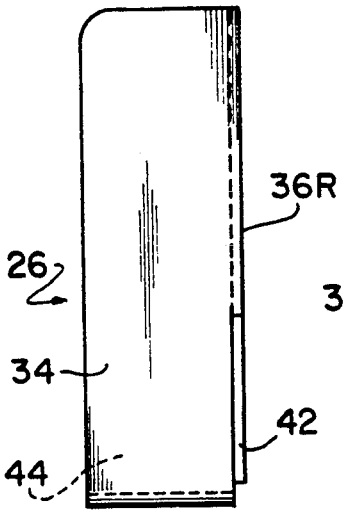
Figure 4:
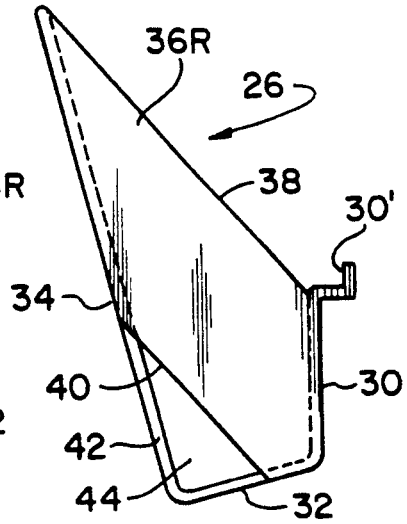
Figure 5:
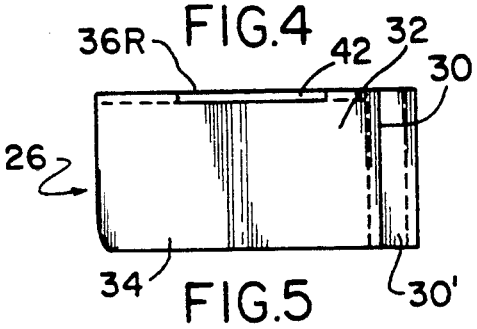
Figure 6:
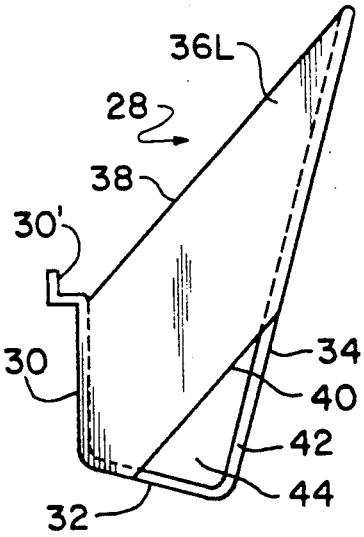
Figure 7:
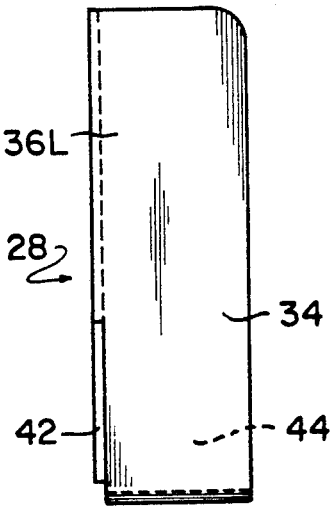
Figure 8:
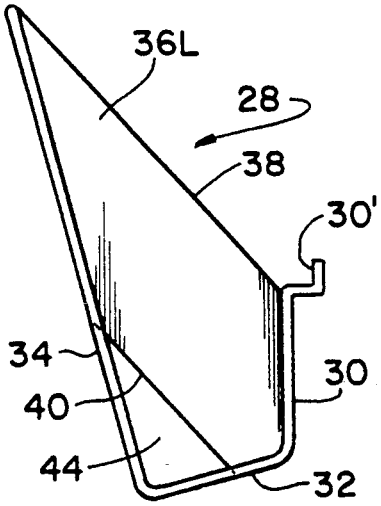
Figure 9:
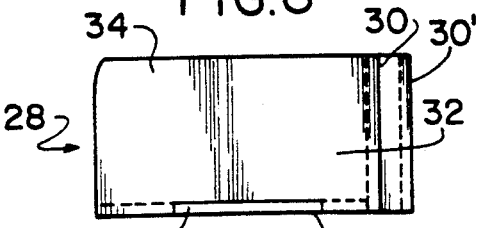

FIG. 11, in addition to FIG. 10, also clearly illustrates the flush relationship of the walls 36L, 36R of the vertically adjacent brackets 28 and 26 which comprise the within inventive display rack 10.

While the display rack 10 herein shown and disclosed in detail is fully capable of attaining the objects and providing the advantages hereinbefore stated, it is to be understood that it is merely illustrative of the presently preferred embodiment of the invention, and that no limitations are intended to the detail of construction or design herein shown other than as defined in the appended claims.

What is claimed is:

1. A magazine display rack of a type for displaying magazines in an operative arrangement of vertically spaced apart tiers consisting of at least a first lower tier and a second upper tier, said display rack comprising a planar support having plural vertically spaced apart horizontally oriented slots, plural cooperating pairs of support brackets slidably disposed in said slots having compartments for supporting opposite bottom corners of magazines disposed for display in spanning relation between each said cooperating support bracket pair such that positions of sliding movement of said cooperating bracket pairs are adapted to be selected to correspond to the width of said magazine in said display position therebetween, and each bracket pair having an operative arrangement of a rear wall, bottom wall, front wall and side wall bounding therebetween said compartment into which a magazine bottom corner is projected, each side wall having an upper angularly oriented edge in spanning relation between said rear wall and front wall and a triangular notch at the juncture of said front wall and bottom wall such that in said vertically spaced apart tiers said bracket side walls are in the same vertical plane with the upper angular oriented edge length portion adjacent the front wall of a first lower tier bracket projected into a triangular notch of a second upper tier bracket, whereby all side walls of said brackets are in vertical alignment with each other to contribute to an enhanced appearance in said magazine display rack.

* * * * *